United States Patent [19]

Larsson

[11] 3,966,593

[45] June 29, 1976

[54] PROCESS AND AN APPARATUS FOR PURIFYING A STREAM OF MECHANICALLY COMMINUTED MATERIAL AS WELL AS FOR ENRICHING FINE ORES AND OTHER MINERALS BY MECHANICAL SORTING

[75] Inventor: John Larsson, Bromma, Sweden

[73] Assignee: Vereinigte Osterreichische Eisen- und Stahlwerke-Alpine Montan Aktiengesellschaft, Linz, Austria

[22] Filed: Mar. 10, 1975

[21] Appl. No.: 556,941

[30] Foreign Application Priority Data

Mar. 12, 1974 Austria ..... 2027/74

[52] U.S. Cl. ..... 209/479; 209/493; 209/494

[51] Int. Cl.[2] ..... B07B 13/08

[58] Field of Search ..... 209/479, 493, 459, 438, 209/423, 427, 435, 443, 444, 457, 458, 466, 468, 471, 474, 475, 494

[56] References Cited

UNITED STATES PATENTS

| | | | |
|---|---|---|---|
| 2,644,583 | 7/1953 | Cannon et al. | 209/459 |
| 2,766,882 | 10/1956 | Cannon et al. | 209/458 X |
| 2,769,545 | 11/1956 | Cannon | 209/493 |
| 2,902,154 | 9/1959 | Cannon | 209/493 X |
| 3,674,144 | 7/1972 | Muller et al. | 209/468 |

FOREIGN PATENTS OR APPLICATIONS

| | | | |
|---|---|---|---|
| 267,035 | 2/1950 | Switzerland | 209/479 |

*Primary Examiner*—Frank W. Lutter
*Assistant Examiner*—Ralph J. Hill
*Attorney, Agent, or Firm*—Brumbaugh, Graves, Donohue & Raymond

[57] ABSTRACT

A process and an apparatus for purifying a stream of mechanically comminuted material as well as for enriching fine ores and other minerals uses mechanical sorting. The thickness of the material stream is enlarged by shaking and an upper and a lower layer containing bigger or lighter and smaller or heavier particles, respectively, form due to the effect of gravity on the material stream. The layers are separated by the edge of a tube, whereupon the upper layer leaves the apparatus through the tube. A preferably exchangeable or liftable and lowerable disc deflects the path of the lower layer of the material stream in a meander-like or winding manner to controllably brake the speed of that material stream.

4 Claims, 1 Drawing Figure

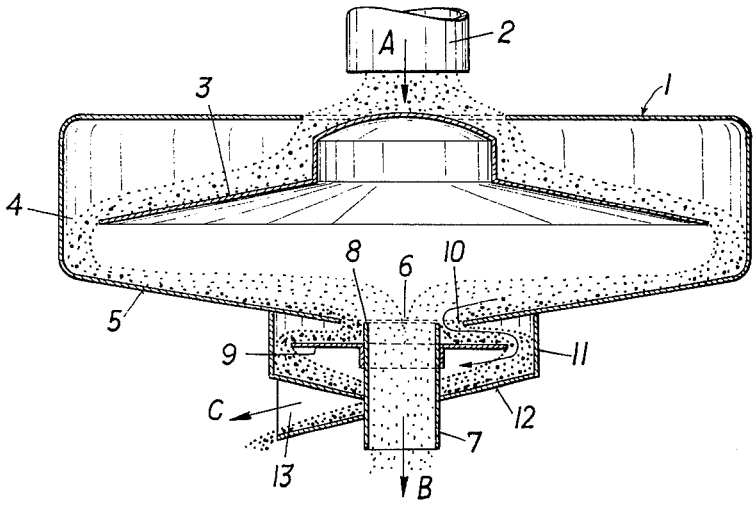
A
2
3
1
4
8
6
10
5
9
11
C
12
7
13
B

PROCESS AND AN APPARATUS FOR PURIFYING A STREAM OF MECHANICALLY COMMINUTED MATERIAL AS WELL AS FOR ENRICHING FINE ORES AND OTHER MINERALS BY MECHANICAL SORTING

BACKGROUND OF THE INVENTION

The invention relates to a process for purifying a stream of mechanically comminuted material, such as chips from wood cutting and sawdust, as well as for enriching fine ores and other minerals by mechanical sorting. With prior art processes the thickness of a material stream is enlarged under shaking and the lower layer of the material stream is enriched with heavier or smaller particles, respectively, due to the effect of gravity. The upper layer containing lighter or bigger particles, respectively, is then separated by means of a mechanically active separating or cutting means.

According to a suggestion not yet belonging to the prior art, the stream of raw material is subjected to a mechanical purification without the addition of a liquid, and two fractions are created in a dry sorting manner. The heavier particles form the lower layer and the lighter particles form the upper layer. In the above mentioned process, in which the separating means are formed as a horizontal disc arranged above the level of the bottom opening, depending on the material to be processed it may happen that the material builds up and the removal of the lower stream of material is disturbed, especially when materials of a higher specific gravity (such as fine ores) have to be treated. It is desireable to be able to control the removal speed for the lower material stream and to adapt it to the processing of materials of various specific gravities.

SUMMARY OF THE INVENTION

According to the present invention this problem is solved in that the lower layer of the material stream is deflected in a winding or meander-like manner immediately after its separation and the speed of the material stream is thereby controllably braked.

When chips from wood cutting and sawdust are purified, which are intended for the production of cellulose, cardboard or fiber boards, the desired purified material is obtained as the upper layer. When fine ores are enriched, the desired enriched layer is obtained as the lower layer.

Furthermore, the invention comprises an apparatus for carrying out the process with a shaking device having a cone-shaped distributing body, wherein an annular gap is provided between the jacket of the shaking device and the cone-shaped distributing body. The bottom of the shaking device is inclined from the outside to the inside and an outlet tube is arranged in an opening in the middle of the bottom of the shaking device. An annular gap for removing the material layer to be separated surrounds the outlet tube. The apparatus is characterised in that below the tube mouth, which acts as a mechanical cutting means, a disc is provided on the tube. This disc is surrounded by an annular chamber and forms a path of deflection for the material stream to be separated between the wall of the tube and the annular chamber.

According to preferred embodiments, discs of various diameters are exchangeable and/or the disc is liftable and lowerable on the tube in order to control the braking effect on the material stream to be separated.

BRIEF DESCRIPTION OF THE DRAWING

The process of the invention and the apparatus carrying it out shall now be described with reference to the accompanying drawing which schematically illustrates a vertical section through the apparatus of the present invention.

DESCRIPTION OF A PREFERRED EMBODIMENT

The apparatus comprises a shaking device 1, whose horizontal cross-section may be circular or polygonal. The material stream A flows from the inlet 2 onto the cone-shaped distributing body 3. A gap 4 is formed between the distributing body 3 and the wall of the shaking device. The bottom 5 is inclined towards the central outlet opening 6. A tube 7 is centrally arranged in said opening 6, and the upper edge 8 of said tube 7 ends at about the level of the bottom opening 6. This upper edge 8 acts as separating means for the material stream. The tube 7 can be rigidly connected to the shaking device, so that it performs the same oscillating movement as the shaking device. Somewhat below the mouth of the tube, the tube is surrounded by an annular flange 9 or disc, which is secured to the jacket of the tube. Suitably, this disc can be exchanged for other discs of smaller or larger diameters. Furthermore it is suitable to arrange the disc 9 on the tube 7 so as to be vertically displaceably in order to be able to control the distance of the disc from the edge of the bottom opening 10. The tube 7 and the disc 9 are surrounded by an annular chamber 11 secured to the bottom 5 and having an inclined bottom 12. This annular chamber opens into an outlet opening 13. By arranging the disc below the annular opening between the edges 8 and 10, the wall 11 and the bottom 12 of the annular chamber, a winding path of deflection with two 180° turns, is formed as indicated by the arrow.

The material stream A, consisting of fine ore, e.g., falls from the inlet 2 onto the cone-shaped distributing plate 3 of the shaking device 1 and migrates towards the periphery of the shaking device. The material drops through gap 4 and falls to the inclined bottom 5, forming a relatively thin layer at first. Because of the shaking movement and the inclination of the bottom 5, the material moves towards the center while the layer increases in thickness. Due to the shaking movement, the particles of greater specific gravity collect in the lower layer of the migrating material stream. At the tube edge 8, which acts as separating or stream cutting means, the material stream splits into two parts. Stream C contains the heavier particles that are deflected into the annular chamber 11, travel through it in a winding path and finally are transported via the inclined bottom 12 of the annular chamber to the outlet 13. The specifically lighter particles of the split stream B, i.e. the gangue, fall through the tube 7. By selecting the diameter of disc 9 and adjusting the distance of disc 9 from the annular opening between the edges 8 and 10, the speed of the material stream through chamber 11 can be controlled and adapted to the respective conditions of operation for achieving an optimum separation effect. The adjustability of the disc thus has the function of a material stream control valve.

What I claim is:

1. In a process for purifying a stream of mecanically comminuted material, such as chips from wood cutting and sawdust, as well as for enriching fine ores and other minerals by mechanical sorting, in which a stream of material is subjected to shaking and is thereby thickened, whereupon, due to gravity, a lower layer of the stream of material forms, which is rich in heavier and smaller particles, while an upper layer of the stream of material, which contains lighter and bigger particles, forms thereabove, and in which said upper layer is separated by a mechanically acting separating means, the improvement comprising the step of deflecting said lower layer of the stream of material in a winding manner immediately after separation of said upper layer so as to controllably brake the speed of said lower layer material stream after separation.

2. An apparatus for purifying a stream of mechanically comminuted material, such as chips from wood cutting and sawdust, as well as for enriching fine ores and other minerals by mechanical sorting, which comprises:

a shaking device having a jacket and an inwardly inclined bottom with a central bottom opening;

a cone-shaped distributing body arranged within said shaking device, a first annular gap being provided between the jacket of the shaking device and said cone-shaped distributing body;

an outlet tube arranged in the central bottom opening of the shaking device and surrounded by a second annular gap, said outlet tube having an upper edge acting as a mechanical separating means;

a disc arranged on said outlet tube below the upper edge thereof; and an annular chamber surrounding said disc, said annular chamber, said outlet tube and said disc forming a winding path of deflection for the stream of material to be separated, said winding path controllably braking the speed at which the stream of material to be separated leaves the apparatus.

3. An apparatus as set forth in claim 2, wherein, for controllably braking the stream of material to be separated, said disc is exchangeable for other discs of varying diameters.

4. An apparatus as set forth in claim 2, wherein, for controllably braking the stream of material to be separated, said disc is liftable and lowerable on said outlet tube.

* * * * *